US007665634B2

(12) United States Patent
Pressler

(10) Patent No.: US 7,665,634 B2
(45) Date of Patent: Feb. 23, 2010

(54) SINK ORGANIZER

(76) Inventor: Shula Pressler, 17530 Tuba St., Northridge, CA (US) 91325

( * ) Notice: Subject to any disclaimer, the term of this patent is extended or adjusted under 35 U.S.C. 154(b) by 680 days.

(21) Appl. No.: 11/383,731

(22) Filed: May 16, 2006

(65) Prior Publication Data

US 2007/0267446 A1 Nov. 22, 2007

(51) Int. Cl.
*B67D 1/07* (2006.01)
*B65D 23/12* (2006.01)
*A47G 19/00* (2006.01)

(52) U.S. Cl. ..... 222/192; 222/132; 222/135; 222/255; 220/23.83; 215/390

(58) Field of Classification Search ..... 222/132, 222/135, 156, 158, 192, 255; 220/23.86; 215/390

See application file for complete search history.

(56) References Cited

U.S. PATENT DOCUMENTS

| | | | | |
|---|---|---|---|---|
| 3,459,343 | A * | 8/1969 | Rasmussen | 222/477 |
| D290,434 | S | 6/1987 | Brown | |
| 4,913,319 | A * | 4/1990 | Root | 222/135 |
| 5,044,522 | A * | 9/1991 | Roig et al. | 222/108 |
| D341,973 | S | 12/1993 | Gerstmar | |
| 5,690,255 | A * | 11/1997 | White | 222/135 |
| D399,131 | S | 10/1998 | Eichler | |
| D414,362 | S | 9/1999 | Olmos | |
| D465,367 | S | 11/2002 | Pruijssers | |
| 6,530,502 | B2 | 3/2003 | Neal | |
| 2005/0133538 | A1 | 6/2005 | Herrmann | |

* cited by examiner

*Primary Examiner*—Kevin P Shaver
*Assistant Examiner*—Melvin A Cartagena
(74) *Attorney, Agent, or Firm*—QuickPatents, Inc.; Kevin Prince

(57) ABSTRACT

A combination dispenser and implement holder is disclosed. The combination comprises a plurality of containers, each for retaining a liquid. Each container includes a bottom wall, at least one side wall, and a top wall. The top wall of each container preferably includes a dispensing nozzle. Each container is fluidly isolated from each other container by at least one of the side walls so that mixing of the liquids does not occur. A towel rack projects from at least one side wall of at least one container, and preferably a sponge holder projects from the same wall below the towel rack. Drain holes are included in a bottom wall of the sponge holder. In one embodiment of the invention having three containers, the width of the third container is preferably larger than the width of the sponge holder and the towel rack. As such, when viewing the combination from the front, neither the towel rack or the sponge holder are visible.

14 Claims, 3 Drawing Sheets

SINK ORGANIZER

CROSS-REFERENCE TO RELATED APPLICATIONS

Not applicable.

STATEMENT REGARDING FEDERALLY SPONSORED RESEARCH AND DEVELOPMENT

Not applicable.

FIELD OF THE INVENTION

This invention relates to sink organizers, and more particularly to a combination multi— container liquid dispenser, towel holder, and sponge receptacle.

DISCUSSION OF RELATED ART

Counter space near kitchen and bathroom sinks is often scarce, particularly when there are multiple dispensers for soap, hand lotion, dishwashing soap, and the like. Sponge holders and wash cloth racks consume even more space, and in general are unsightly in appearance.

Organizing such implements around a sink is typically addressed in patents relating to sink organizers and caddies, such as U.S. Pat. No. 6,530,502 to Neal on Mar. 11, 2003. Such a device has two dispensers for different liquids, and sponge and brush holders. However, such a device does nothing to shield the casual observer from the unsightly scouring implements organized in such a device. Further, such a device does not make any provisional for holding a dish rag.

U.S. Design Pat. No. 414,362 to Olmos on Sep. 28, 1999 teaches a similar sink organizing unit. Such a device has a similar drawback to the -502 device, namely that of keeping the unsightly scrubbing sponge in plain view. This device has the further drawback of only providing for one dispensing container, although conceivably other containers could be held in the open spaces therein. However, having a plurality of different containers is also unsightly, in that the containers, dispensing nozzles, and sizes typically do not match. U.S. Design Pat. No. 341,973 to Gerstmar on Dec. 7, 1993 has many of these same drawbacks.

US Patent Application 2005/0133538 to Herrmann on Jun. 23, 2005 teaches a dispenser that includes gap formed between a U-shaped spray bottle container for holding such implements as sponges, dishrags, paper towels, or the like. This device clearly does nothing to shield the unsightly cleaning implement from casual view, and is designed primarily for portable use such as while washing windows, or the like. Multiple container dispensers are also known in the art, such as those found in U.S. Design Pat. No. 399,131 to Eichler on Oct. 6, 1998; U.S. Design Pat. No. D290,434 to Brown on Jun. 23, 1987; and U.S. Design Pat. No. D290,434 to Pruijssers on Nov. 12, 2002. These devices each include a plurality of integrally formed or attached containers having a similar appearance. Such devices make no provision for holding a sponge or wash cloth, and further have the drawback that each container portion must be labeled in some way so that the user can distinguish between the liquids in each container. Therefore, there is a need for an aesthetically pleasing multi-container dispenser that provides for holding unsightly scrubbing implements generally out-of-sight, yet still within convenient reach. Such a needed device would have a relatively small countertop footprint so as to conserve counter space around the sink. Further, such a device would be relatively easy to use, each container being distinctive in appearance from each other container. The present invention accomplishes these objectives.

SUMMARY OF THE INVENTION

The present device is a combination dispenser and implement holder. The combination comprises a plurality of containers, such as two, three, four or more containers, each for retaining a liquid. Each container includes a bottom wall, at least one side wall, and a top wall. The top wall of each container preferably includes a dispensing nozzle. Each container is fluidly isolated from each other container by at least one of the side walls so that mixing of the liquids does not occur.

A towel rack projects from at least one side wall of at least one container, and preferably a sponge holder projects from the same wall below the towel rack. Drain holes are preferably included in a bottom wall of the sponge holder.

In one embodiment of the invention, the combination includes exactly three containers, and optionally each container in such an embodiment includes a front wall that is generally parallel to the front wall of each other container. Further, each container optionally includes exactly two side walls, each of which is substantially orthogonal to the front wall. In such an embodiment, the width of the third container is preferably larger than the width of the sponge holder and the towel rack. As such, when viewing the combination from the front, neither the towel rack or the sponge holder are visible. Other embodiments of the invention, for example, those having exactly two containers or four containers, are clearly possible without departing from the spirit and scope of the invention. An alternate embodiment includes a plurality of cylindrical containers, such that each container has only one side wall around its perimeter. Further, any combination of opaque, translucent, or transparent containers, of any color, could be combined to form the combination of the present invention.

The present invention is an aesthetically pleasing multi-container dispenser that provides for holding unsightly scrubbing implements generally out-of-sight, yet still within convenient reach. The present device has a relatively small countertop footprint so as to conserve counter space around the sink. Further, the present invention is relatively easy to use, each container being distinctive in appearance from each other container. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 1:
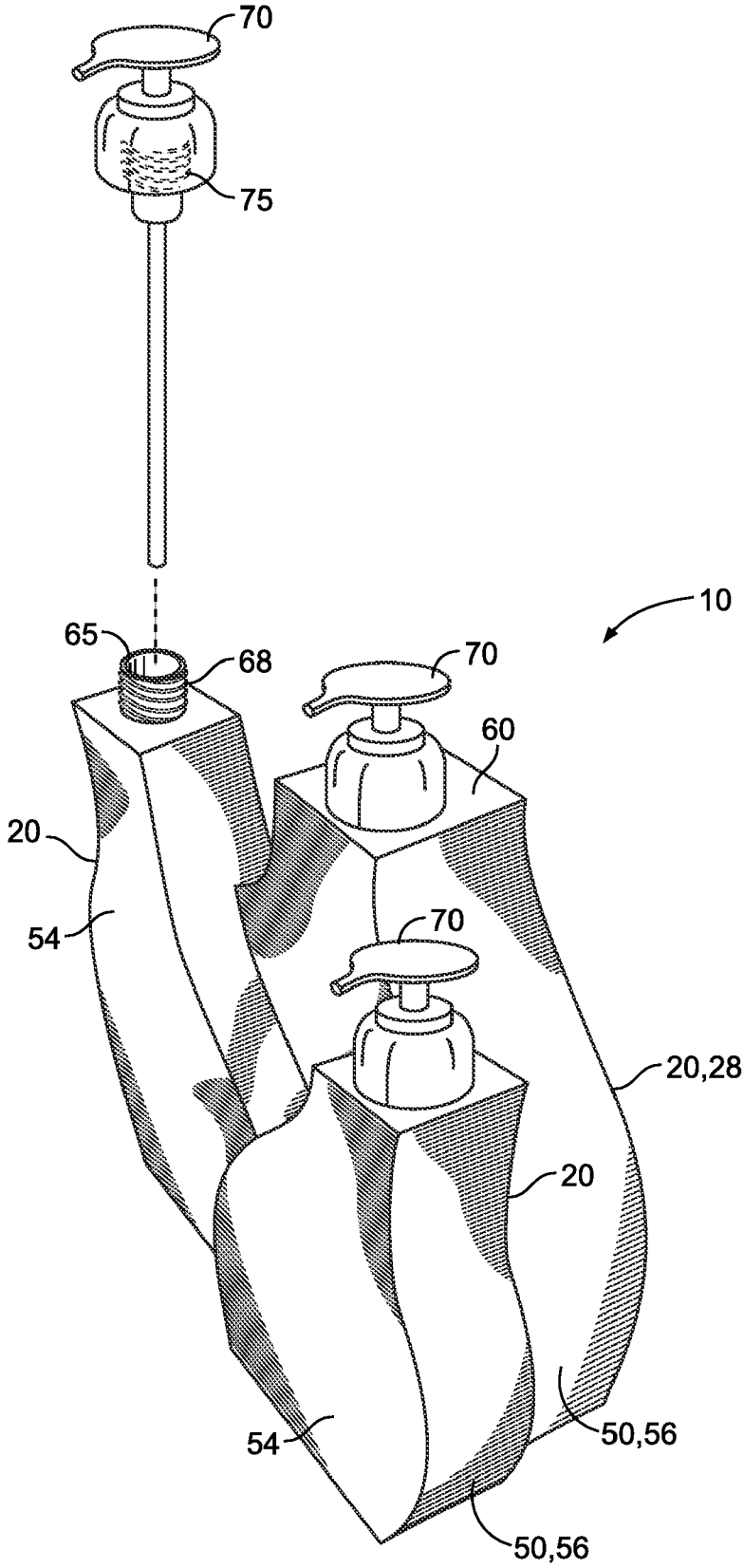
FIG. 1 is a perspective drawing of the invention, illustrating a plurality of dispensers of the present design and dispenser pumps in phantom outline.
Figure 2:
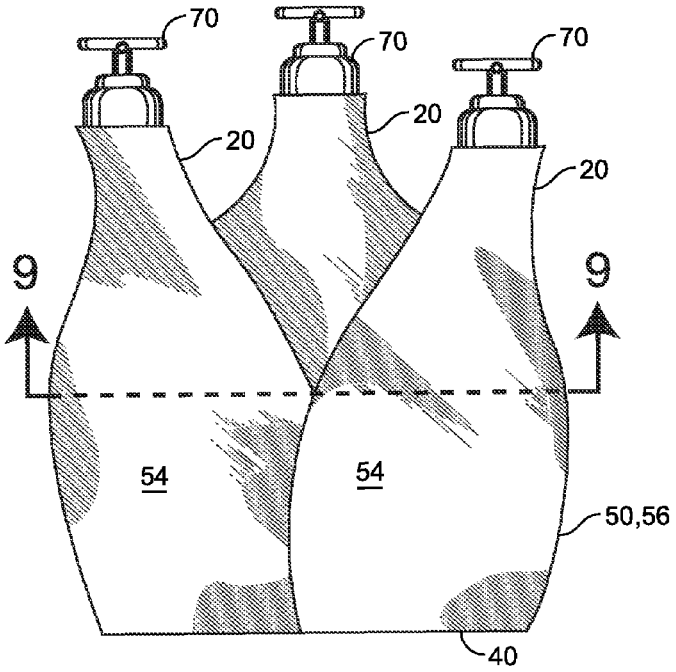
FIG. 2 is a front elevational view of the invention.
Figure 5:
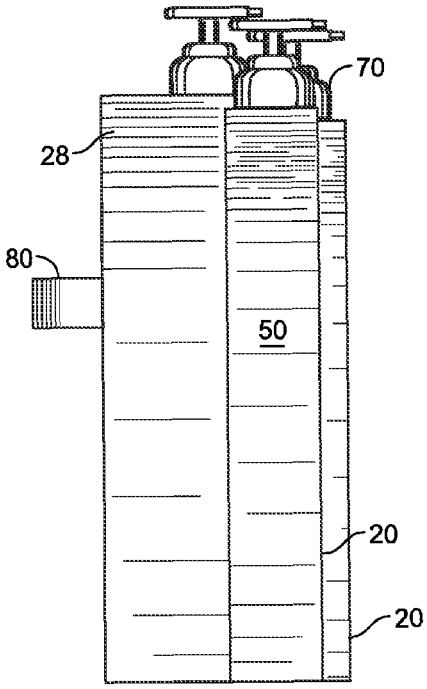
FIG. 5 is a right-side elevational view of the invention.
Figure 4:
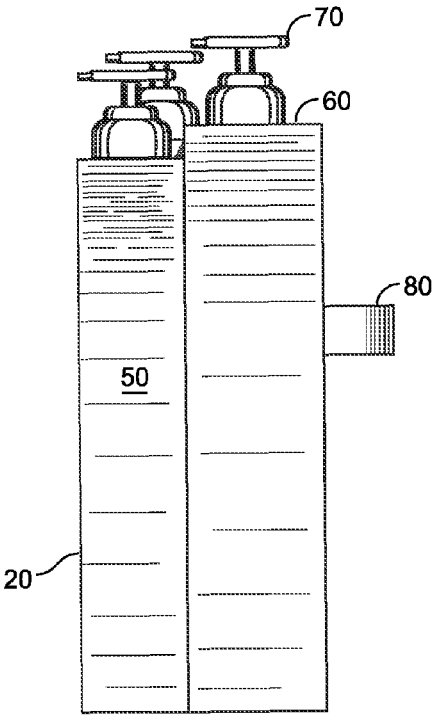
FIG. 4 is a left-side elevational view of the invention.

FIG. 1 illustrates a combination dispenser and implement holder 10. The combination 10 comprises a plurality of containers 20, such as two, three, four or more containers 20, each for retaining a liquid (not shown). Each container 20 includes a bottom wall 40 (FIGS. 2 and 3), at least one side wall 50, and a top wall 60. The top wall 60 of each container 20 preferably includes a neck portion 65 (FIGS. 1 and 9) which includes a thread 68 for cooperative engagement with a thread 75 of a dispensing nozzle 70. However, other attachment means for attaching one of the dispensing nozzles 70 to each container 20 may be devised by those skilled in the art. Each container 20 is fluidly isolated from each other container 20 by at least one of the side walls 50 so that mixing of the liquids does not occur. Each container 20 further shares at least one side wall 50 with at least one other container 20, such share side wall 52 being best illustrated in the cross-sectional views of FIGS. 8 and 9. One of the dispensing nozzles 70 is fixed to each top wall 60 of each container 20 for moving a liquid therein from inside the container 20 to outside of the container 20, such as by manual pumping or electric pump.

Figure 3:
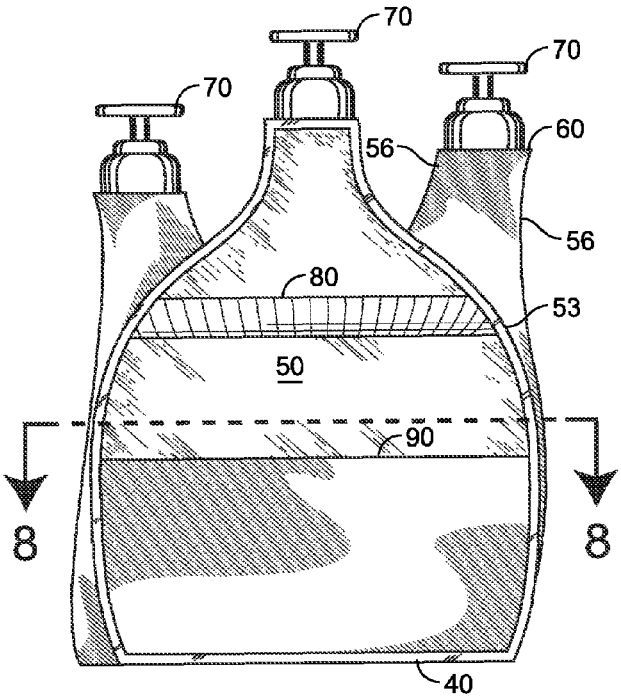
FIG. 3 is a rear elevational view of the invention, illustrating a towel rack and a sponge holder of the present design.
Figure 8:
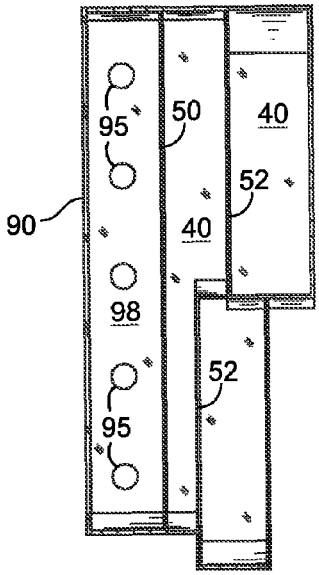
FIG. 8 is a cross-sectional view of the invention, taken generally along lines 8-8 of FIG. 3.
Figure 9:
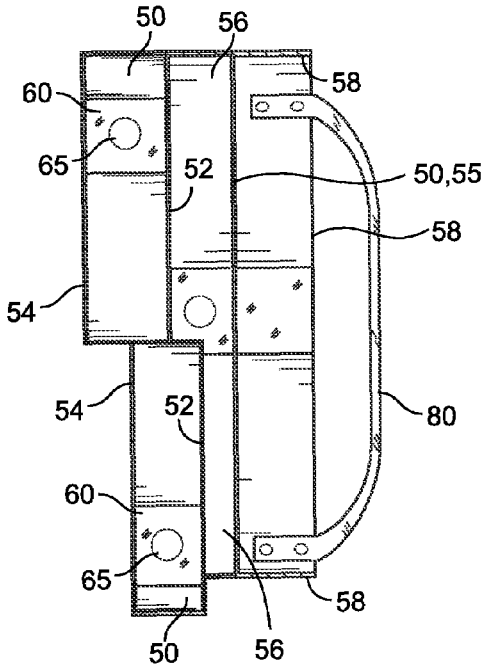
FIG. 9 is a cross-sectional view of the invention, taken generally along lines 9-9 of FIG. 2.
Figure 6:
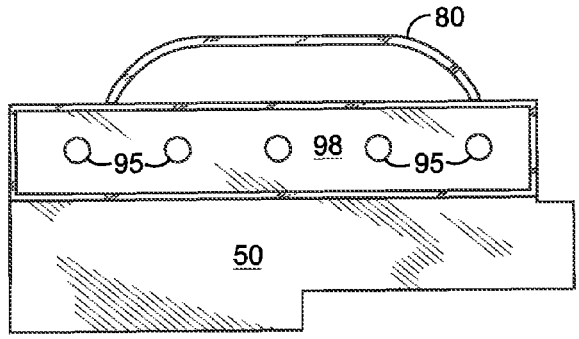
FIG. 6 is a bottom plan view of the invention, illustrating apertures in a bottom portion of the sponge holder.
Figure 7:
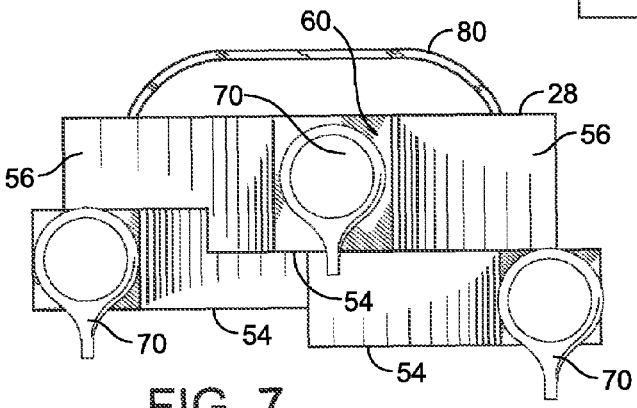
FIG. 7 is a top plan view of the invention.

A towel rack 80 projects from at least one side wall 50 of at least one container 20, and preferably a sponge holder 90 projects from the same wall 50 below the towel rack 80 (FIGS. 3, 6, and 7). Drain holes 95 are preferably included in a bottom wall 98 of the sponge holder 90 (FIGS. 6 and 8).

In one embodiment of the invention, the combination 10 includes exactly three containers 20, and optionally each container 20 in such an embodiment includes a front wall 54 that is generally parallel to the front wall 54 of each other container 20. Further, each container 20 optionally includes exactly two side walls 56, each of which is substantially orthogonal to the front wall 54 (FIG. 7). In such an embodiment, the width of the third container 28 is preferably larger than the width of the sponge holder 90 and the towel rack 80. As such, when viewing the combination 10 from the front, as in FIG. 2, neither the towel rack 80 or the sponge holder 90 are visible. Further, walls 58 extending from a rear side 55 of the third container 28 (FIG. 9) further serve to shield direct visual observation of the sponge holder 90 and the towel rack 80. The towel rack 80 may be fixed to the extending walls 58 with rivets, or the like, or formed integrally therewith. Each top wall 60 is preferably parallel to each other top wall 60, but is not coplanar therewith. As such, each dispensing nozzle 70 may be readily differentiated from each other dispensing nozzle 70 by its relative height, aiding in the user accurately choosing a desired liquid for dispensing. Other embodiments of the invention, for example, those having exactly two containers 20 or four containers 20, are clearly possible without departing from the spirit and scope of the invention. In such embodiments (not shown), other configurations of containers 20 and shared side walls 50 may be devised by those skilled in the art. Further, side walls 56 may or may not be orthogonal to front walls 54. Indeed, one could form a combination 10 of the present invention having a plurality of cylindrical containers 20 (not shown), such that each container 20 has only one side wall 50 around its perimeter.

In one embodiment of the invention, the containers 20 are each made from a translucent material such that the color of the liquids therein may be at least partially visible therethrough. In another embodiment of the invention, the containers 20 are each made from an opaque material. In such an embodiment each container 20 may be formed from an opaque material of the same color, or different colors. Clearly any combination of opaque, translucent, or transparent containers 20, of any color, could be combined to form the combination 10 of the present invention. Preferably each container 20 is formed as an integral piece, such as by plastic injection molding. However, each container 20 may be made separately and securely fixed to the other containers, such that the shared walls 52 are actually two side walls 50 of their respective containers. Such separate containers 20 may be fixed together by adhesive, ultrasonic bonding, or any other suitable means providing that such adhering means does not jeopardize the liquid-tight integrity of any of the containers 20. The towel rack 80 and the sponge holder 90 are preferably made from the same material as is each of the containers 20.

While a particular form of the invention has been illustrated and described, it will be apparent that various modifications can be made without departing from the spirit and scope of the invention. For example, the exact placement of the sound emitting means 20 may vary within the pocket formed by folding the secondary page 70. The tape 90 may alternately be a dab of glue. Accordingly, it is not intended that the invention be limited, except as by the appended claims.

What is claimed is:

1. A combination dispenser and implement holder comprising:

three containers for retaining a plurality of liquids, each container isolated from each other container, each container including a bottom wall, at least one side wall, and a top wall, each container sharing at least one side wall with one of the other containers, each container including a dispensing nozzle fixed to the top wall thereof, each dispensing nozzle for moving one of the plurality of liquids from inside of one container to the outside thereof;

a sponge holder projecting from the at least one side wall of at least one container below the towel rack;

a towel rack projecting from the at least one side wall of at least one container, the width of a third container extending past the width of both the sponge holder and towel rack, such that the sponge holder and towel racks are visually obscured by at least the third container when viewing the combination dispenser and implement holder from the front wall thereof.

2. The combination dispenser and implement holder of claim 1 wherein the sponge holder includes drain holes in a bottom wall thereof.

3. The combination dispenser and implement holder of claim 2 wherein the bottom wall of each container is coplanar with the bottom wall of each other container and the bottom wall of the sponge holder.

4. The combination dispenser and implement holder of claim 1 wherein each container includes a front wall, each wall in a generally parallel plane with each other front wall.

5. The combination dispenser and implement holder of claim 4 each container includes two side walls, each side wall of each container being a curved wall orthogonal to the front wall of its container.

6. The combination dispenser and implement holder of claim 1 wherein each top wall of each container is at a different height with respect to the top wall of each other container.

7. The combination dispenser and implement holder of claim 1 wherein each dispensing nozzle includes a thread cooperating with a thread of a neck portion of each container, the neck portion of each container fixed to the top wall thereof, whereby the dispensing nozzles may each be removed from their respective containers by unscrewing.

8. The combination dispenser and implement holder of claim 1 wherein each container is formed as a single integrated piece.

9. The combination dispenser and implement holder of claim 1 wherein each container is made from a transparent material.

10. The combination dispenser and implement holder of claim 1 wherein each container is made from a translucent material.

11. The combination dispenser and implement holder of claim 10 wherein each container is made from a translucent material of a different color.

12. The combination dispenser and implement holder of claim 1 wherein each container is made from an opaque material.

13. The combination dispenser and implement holder of claim 12 wherein each container is made from an opaque material of a different color.

14. The combination dispenser and implement holder of claim 1 wherein the bottom wall of each container is coplanar with the bottom wall of each other container.

* * * * *